US008450920B2

(12) United States Patent
Wei et al.

(10) Patent No.: US 8,450,920 B2
(45) Date of Patent: May 28, 2013

(54) FIELD EMISSION ELECTRONIC DEVICE

(75) Inventors: Yang Wei, Beijing (CN); Peng Liu, Beijing (CN); Hai-Yan Hao, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 219 days.

(21) Appl. No.: 13/095,859

(22) Filed: Apr. 28, 2011

(65) Prior Publication Data

US 2012/0194058 A1 Aug. 2, 2012

(30) Foreign Application Priority Data

Dec. 21, 2010 (CN) ..... 2010 1 0598615

(51) Int. Cl.
*H01J 19/24* (2006.01)
*H01J 63/04* (2006.01)

(52) U.S. Cl.
USPC ..... 313/496; 313/497; 313/308; 313/309; 313/336; 313/351

(58) Field of Classification Search
None
See application file for complete search history.

(56) References Cited

U.S. PATENT DOCUMENTS

| | | | | |
|---|---|---|---|---|
| 7,585,199 | B2 * | 9/2009 | Takai | 445/51 |
| 7,812,511 | B2 * | 10/2010 | Liu et al. | 313/495 |
| 7,863,806 | B2 * | 1/2011 | Wei et al. | 313/495 |
| 7,997,950 | B2 * | 8/2011 | Wei et al. | 445/50 |
| 8,106,576 | B1 * | 1/2012 | Wei et al. | 313/495 |
| 2002/0060516 | A1 | 5/2002 | Kawate et al. | |
| 2003/0012721 | A1 | 1/2003 | Nakayama et al. | |
| 2005/0127334 | A1 * | 6/2005 | Shibata et al. | 252/502 |
| 2008/0036358 | A1 * | 2/2008 | Takai | 313/495 |
| 2008/0170982 | A1 | 7/2008 | Zhang et al. | |
| 2008/0203886 | A1 * | 8/2008 | Takai et al. | 313/311 |
| 2009/0134772 | A1 | 5/2009 | Wei et al. | |
| 2009/0236965 | A1 | 9/2009 | Liu et al. | |
| 2010/0104808 | A1 | 4/2010 | Fan et al. | |
| 2010/0329501 | A1 | 12/2010 | Liu et al. | |
| 2012/0133267 | A1 * | 5/2012 | Wei et al. | 313/309 |

FOREIGN PATENT DOCUMENTS

| | | |
|---|---|---|
| CN | 101931842 A | 12/2010 |
| JP | 2001-192204 | 7/2001 |
| JP | 2002-150924 | 5/2002 |
| JP | 2004-55484 | 2/2004 |
| JP | 2008-523254 | 7/2008 |
| JP | 2009-117367 | 5/2009 |
| JP | 2009-231289 | 10/2009 |

OTHER PUBLICATIONS

Sumio Iijima, Helical Microtubules of Graphitic Carbon, Nature, Nov. 7, 1991, 56-58, vol. 354, Nature Publishing Group.

* cited by examiner

*Primary Examiner* — Ashok Patel
(74) *Attorney, Agent, or Firm* — Altis Law Group, Inc.

(57) ABSTRACT

The present disclosure provides a field emission electronic device. The field emission electronic device includes an insulating substrate, a first electrical conductor located on surface of the insulating substrate, a number of electron emitters connected to the first electrical conductor, a second electrical conductor spaced apart from and insulated from the first electrical conductor. Each of the number of electron emitters includes at least one electron emitter. Each of the electron emitters includes a carbon nanotube pipe. The carbon nanotube pipe includes a first end, a second end and a main body connecting the first end and the second end. The first end of the carbon nanotube pipe is electrically connected to one of the plurality of row electrodes. The second end of the carbon nanotube pipe has a number of carbon nanotube peaks.

20 Claims, 15 Drawing Sheets

FIELD EMISSION ELECTRONIC DEVICE

CROSS-REFERENCE TO RELATED APPLICATIONS

This application claims all benefits accruing under 35 U.S.C. §119 from China Patent Application No. 201010598615.0, filed on Dec. 21, 2010 in the China Intellectual Property Office, disclosure of which is incorporated herein by reference.

BACKGROUND

1. Technical Field

The present disclosure relates to a field emission electronic device.

2. Description of Related Art

Field emission electronic devices provide many advantages such as low power consumption, fast response speed, and high resolution. Therefore, they are being actively developed.

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs also feature extremely high electrical conductivity, very small diameters (much less than 100 nanometers), large aspect ratios (i.e. length/diameter ratios greater than 1000), and a tip-surface area near the theoretical limit (the smaller the tip-surface area, the more concentrated the electric field, and the greater the field enhancement factor). These features tend to make CNTs ideal candidates for electron emitters.

A carbon nanotube wire is provided as an electron emitter of a field emission electronic device. The carbon nanotube wire includes a first end and a second end opposite to the first end. The first end of the carbon nanotube wire may be connected to a conductive base. The second end of the carbon nanotube wire extends from the conductive base along a direction away from the conductive base. The second end of the carbon nanotube wire is used as an electron emission portion. A number of electrons can be emitted from the second end of the carbon nanotube wire. However a cross section of the second end of the carbon nanotube wire is planar because the carbon nanotube wire is formed by cutting a longer carbon nanotube wire. Therefore, the field emission characteristic of the carbon nanotube wire is bad, and the field emission characteristic of field emission electronic device is also bad.

What is needed, therefore, is to provide a field emission electronic device having improved field emission characteristics.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present field emission electronic device.

Figure 1:
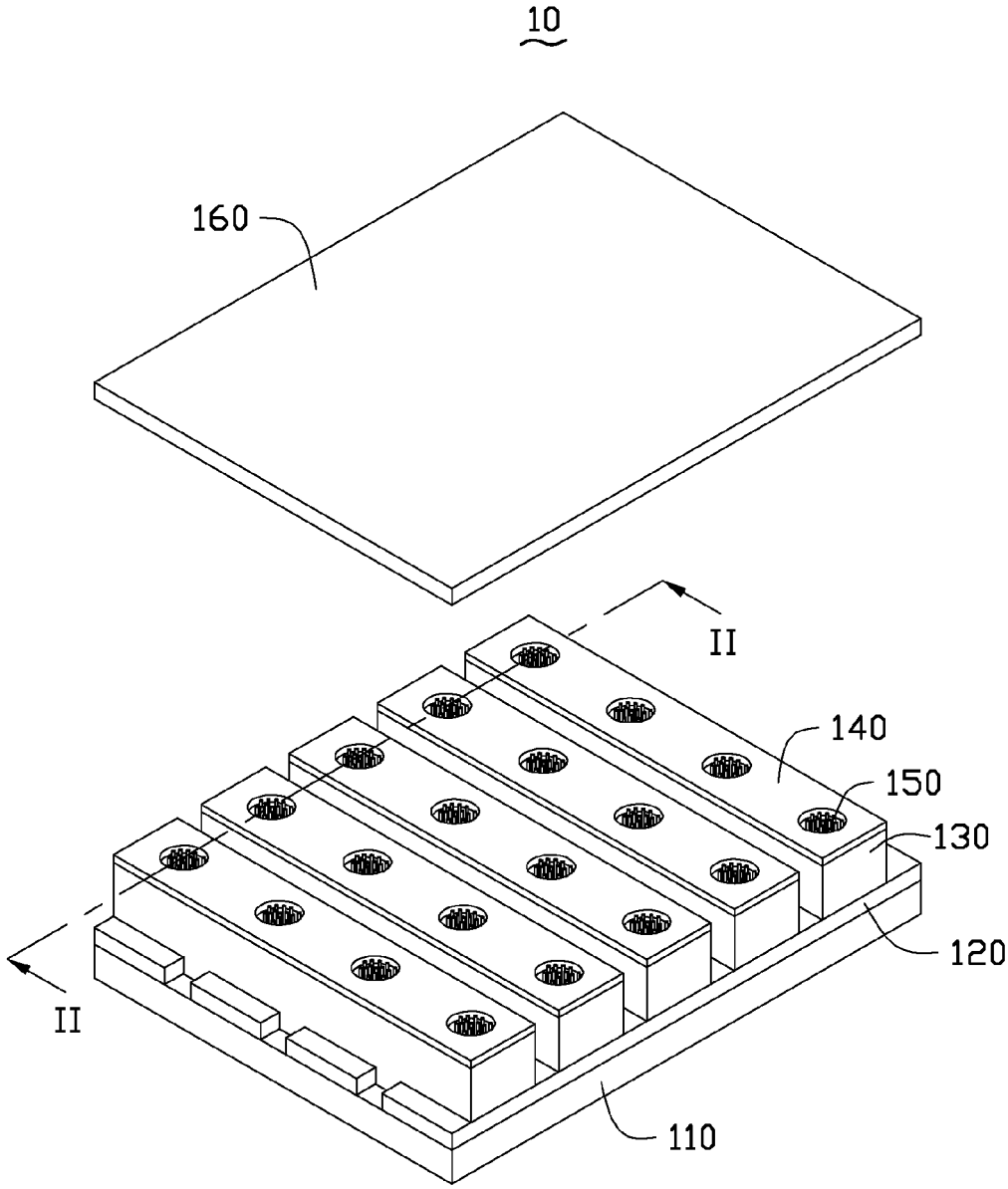
FIG. 1 is a schematic view of one embodiment of a field emission electronic device.
Figure 2:
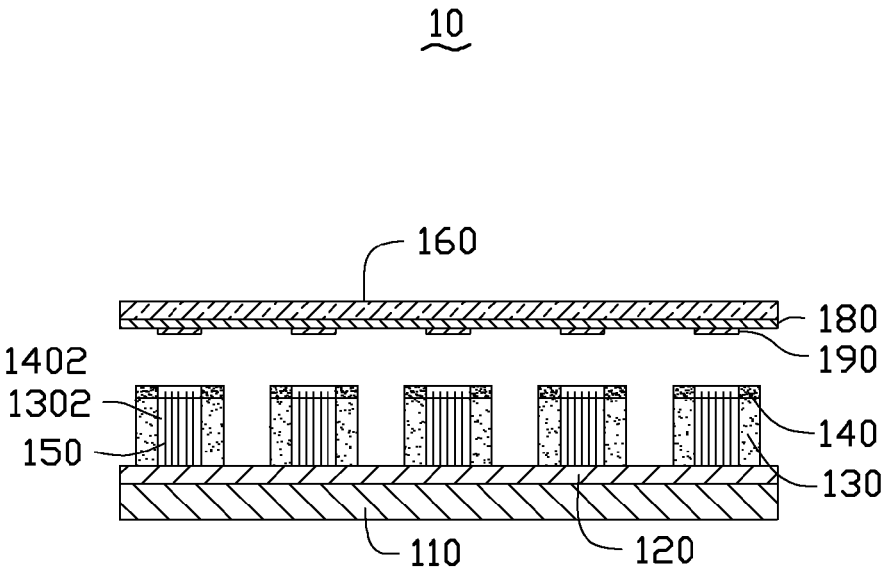
FIG. 2 is a schematic, cross-sectional view, along a line II-II of the field emission electronic device of FIG. 1.
Figure 3:
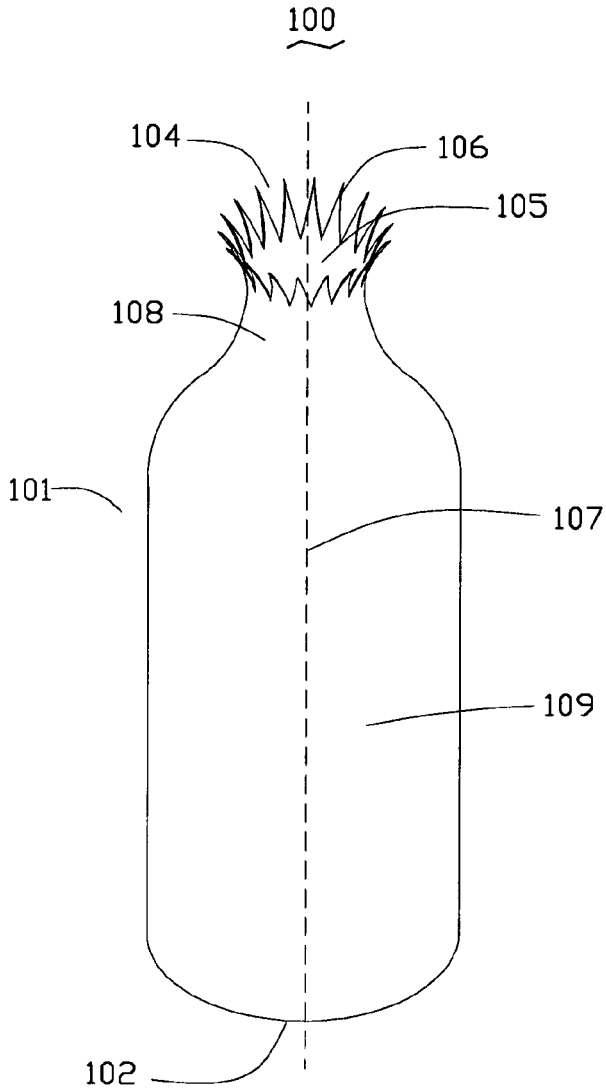
FIG. 3 is a schematic structural view of one embodiment of an electron emitter of the field emission electronic device of FIG. 1.
Figure 4:
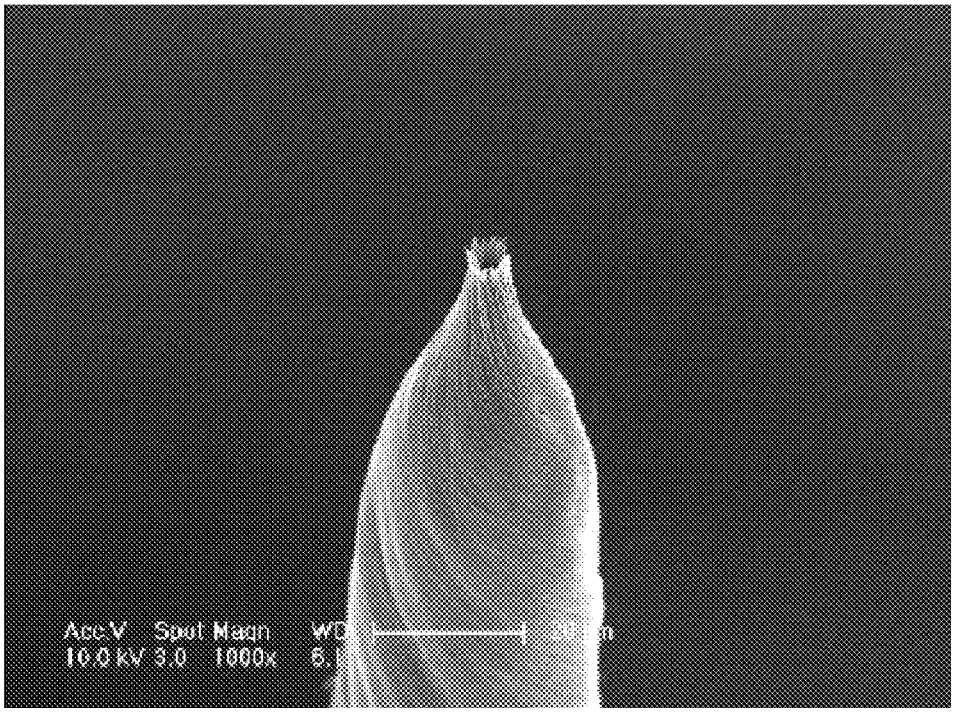
FIG. 4 is a Scanning Electron Microscope (SEM) image of an electron emitter.
Figure 5:
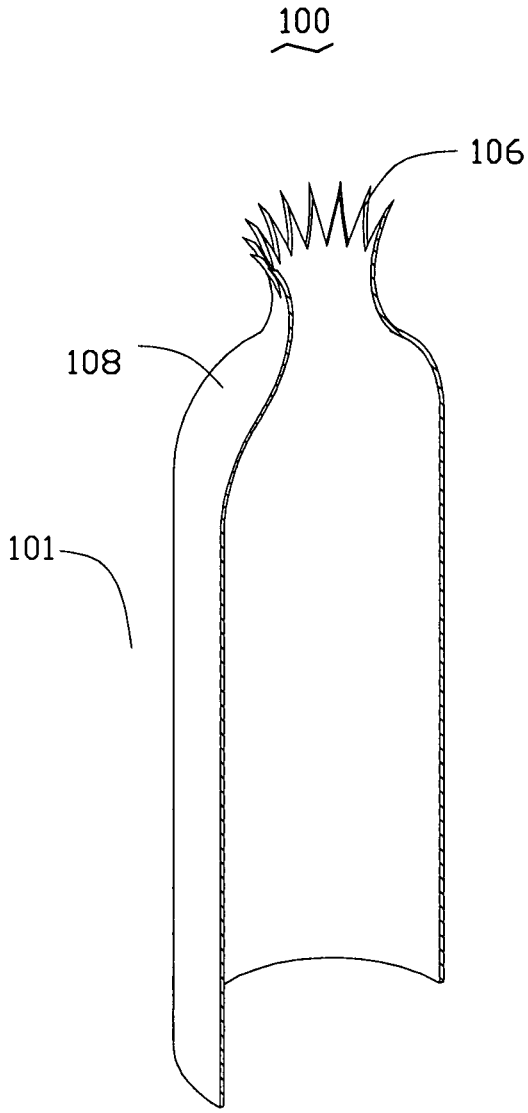
FIG. 5 is a schematic, cross-sectional view, along an axial direction of FIG. 3.
Figure 6:
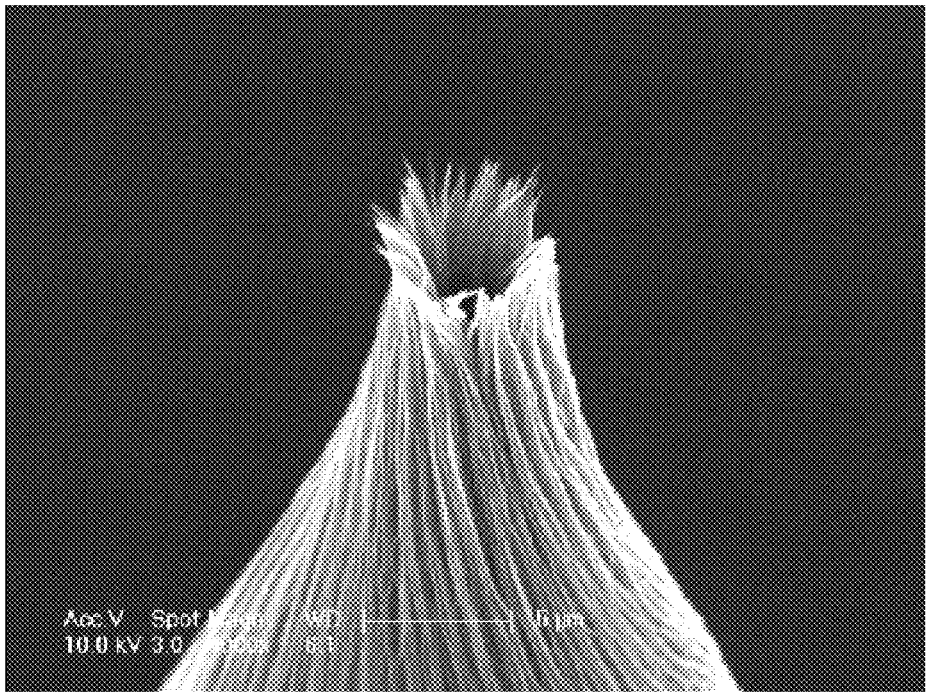
FIG. 6 is an SEM image of one end of the electron emitter of FIG. 3.
Figure 7:
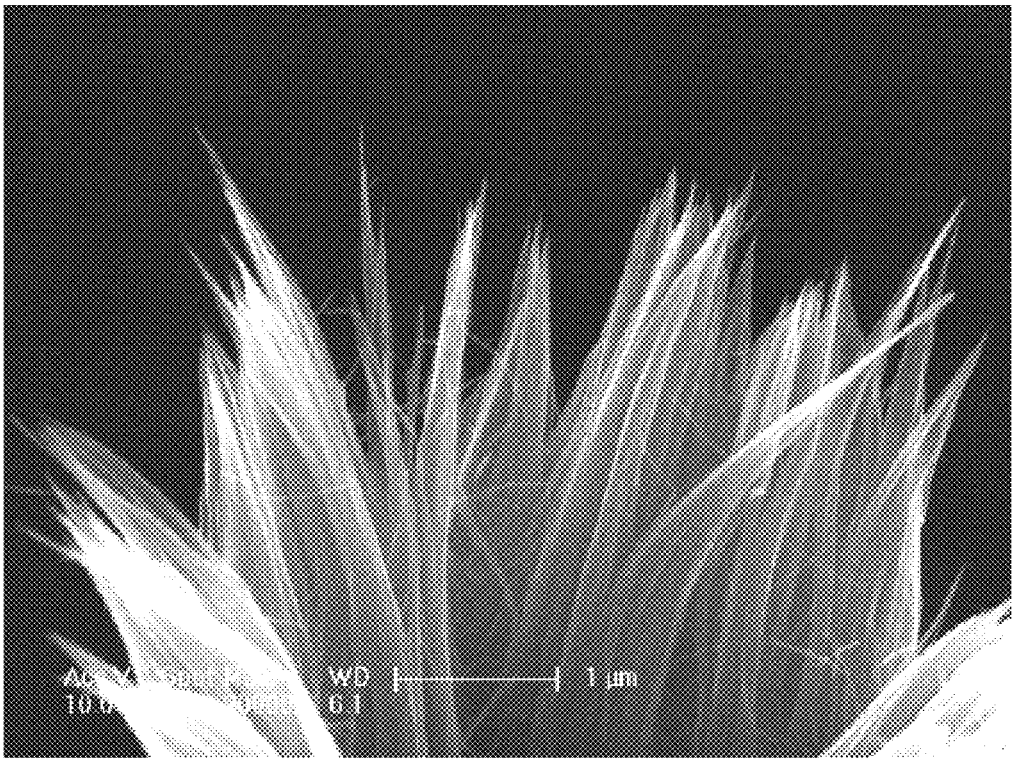
FIG. 7 is an SEM image of a number of carbon nanotube peaks of the electron emitter of FIG. 3.

Referring to FIG. 1 and FIG. 2, one embodiment of a field emission electronic device 10 is provided. The field emission electronic device 10 includes an insulating substrate 110, a number of row electrodes 120, an insulating layer 130, a number of line electrodes 140, a number of cathode emitters 150, an anode substrate 160, an anode electrode 180 and a number of fluorescent layers 190.

The row electrodes 120 are located on a surface of the insulating substrate 110. The row electrodes 120 are spaced apart from and parallel to each other. The insulating layer 130 is located on the insulating substrate 110 and covers a portion of the surfaces of the row electrodes 120. The insulating layer 130 defines a number of holes 1302. Each hole 1302 is corresponding to one of the intersections of the row electrodes 120 and the line electrodes 140. The line electrodes 140 are positioned on the insulating layer 130 and supported by the insulating layer 130. The line electrodes 140 are spaced apart from and parallel to each other. The line electrodes 140 are insulated from the row electrodes 120 by the insulating layer 130. The line electrodes 140 define a number of holes 1402 with each corresponding to one of the intersections of the row electrodes 120 and the line electrodes 140. The holes 1302 are aligned with the holes 1402. The cathode emitters 150 are located corresponding to the intersections of the row electrodes 120 and the line electrodes 140 and in the holes 1302 and the holes 1402. The cathode emitters 150 are located on surfaces of the row electrodes 120 and electrically connected to the row electrodes 120. The fluorescent layers 190 correspond to the intersections of the row electrodes 120 and the line electrodes 140 so each cathode emitter 150 corresponds to and is oriented to one fluorescent layer 190.

The insulating substrate 110 can be made of glass, silicon dioxide, ceramic, or other insulating materials. In one embodiment, the insulating substrate 110 is made of glass.

The row electrodes 120 may be strip or ribbon. The row electrodes 120 can be made of copper, aluminum, gold, silver, indium tin oxide or a combination thereof. In one embodiment, the row electrodes 120 are made of silver.

The shape of the insulating layer 130 is not limited. The insulating layer 130 includes a number of insulators in one embodiment. The shape of the insulators may be strip or ribbon. The insulators are spaced apart from and parallel to each other. The insulating layer 130 can be an insulating board defining a number of holes. The insulating board and the insulating substrate 110 can be one-body formed in one embodiment. The insulating layer 130 can be made of glass, silicon dioxide, ceramic, or other insulating materials. The height of the insulating layer 130 is greater than 15 micrometers. The height of the insulating layer 130 should not be too high, or else the voltage applied to the line electrodes 140 will be too great.

The line electrodes 140 can be made of copper, aluminum, gold, silver, indium tin oxide or a combination thereof. In one embodiment, the line electrodes 140 correspond to the insulators. The line electrodes 140 and the insulators are stacked orderly.

The anode electrode 180 can be made of an indium tin oxide film. The anode substrate 160, the anode electrode 180 and the fluorescent layers 190 constitute an anode device. The anode device is spaced apart from the insulating substrate 110 to form a sealed space.

The cathode emitters 150 are arranged in an array. Each of the cathode emitters 150 include at least one electron emitter 100. Referring to FIGS. 3 to 7, the electron emitter 100 of one embodiment includes a carbon nanotube pipe 101. The length of the carbon nanotube pipe 101 can be selected according to need. The cross section of the carbon nanotube pipe 101 can be circular, ellipsoid, quadrangular, triangular, or polygonal. The carbon nanotube pipe 101 includes a number of carbon nanotubes joined by van der Waals attractive force. In one embodiment, the carbon nanotube pipe 101 includes a number of successive and oriented carbon nanotubes. Most of the carbon nanotubes are helically oriented around an axis 107 of the carbon nanotube pipe. It is understood that the carbon nanotube pipe 101 may have a few carbon nanotubes not helically oriented around the axis 107, but oriented disorderly and randomly. The helically oriented carbon nanotubes are joined end-to-end by van der Waals attractive force therebetween along a helically extending direction. An pitch of the helically oriented carbon nanotubes can be greater than 0 degrees and less than or equal to 90 degrees. In one embodiment, the angle $\alpha$ between the helically extending direction and the axis 107 is greater than or equal to 30 degrees and less than or equal to 60 degrees.

The electron emitter 100 comprises a carbon nanotube pipe 101 including a first end 102, a second end 104, and a main body 109 connecting the first end 102 and the second end 104. The second end 104 is used as an electron emission portion. The second end 104 defines an opening 105 and includes a hollow neck portion 108 connected to the body 109. A number of carbon nanotube peaks 106 extend from a top of the hollow neck portion 108 to surround the opening 110. The carbon nanotube peaks 106 are located around the opening 105 and spaced from each other. The diameter of the hollow neck portion 108 gradually diminishes along a direction apart from the first end 102 and forms a substantially conical shape. When an electric voltage is applied to the electron emitter 100, the electric field will be concentrated at the hollow neck portion 108 to help the electron emitter 100 emit electrons. The carbon nanotube peaks 106 are located around an axis 107 of the carbon nanotube pipe 101 and spaced from each other to form an angular shape. Each of the carbon nanotube peaks 106 is a tapered carbon nanotube bundle and functions as an electron emitter. The carbon nanotube peaks 106 can extend along a same direction that is substantially parallel with the axis 107. The carbon nanotube peaks 106 point to a direction away from the first end 102 of the electron emitter 100. The carbon nanotube peaks 106 can also extend along different directions extending from the opening to form a radial shape. If the carbon nanotube peaks 106 form a radial shape, the size of the opening 105 of the second end 104 gradually increases where the neck portion 108 connects to the carbon nanotube peaks 106. The distance between two adjacent carbon nanotube peaks 106 gradually increases. Thus, the screening effect between the carbon nanotube peaks 106 is reduced. The effective diameter of the opening 105 where the neck portion 108 connects with the carbon nanotube peaks 106 can be in a range from about 4 micrometers to about 6 micrometers. In one embodiment, the opening 105 is round and has a diameter of about 5 micrometers.

Figure 8:
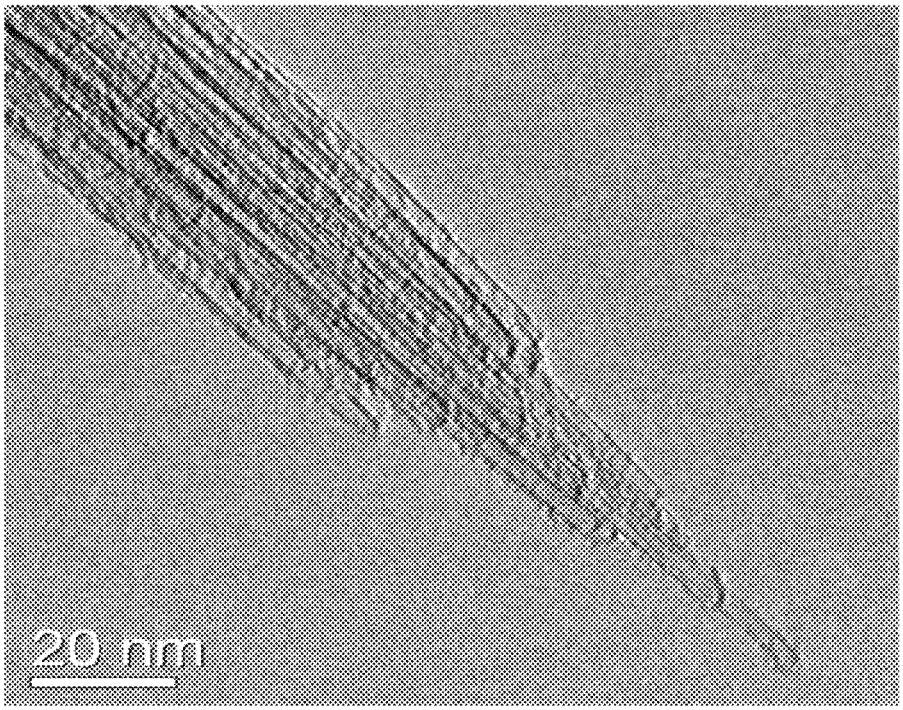
FIG. 8 is a transmission electron microscope (TEM) image of a carbon nanotube peak of the electron emitter of FIG. 3.

Referring also to FIG. 8, the carbon nanotube peak 106 includes a number of carbon nanotubes substantially parallel to each other and joined by van der Waals attractive force. A single projecting carbon nanotube is taller than and projects over other carbon nanotubes in the carbon nanotube peak 106. The single projecting carbon nanotube can be located within the middle of the other carbon nanotubes. The diameter of the carbon nanotubes is less than 5 nanometers, and the number of graphite layers of each carbon nanotube is about 2 to 3. In one embodiment, the diameter of the carbon nanotubes is less than 4 nanometers. Therefore, the aspect ratio of the carbon nanotubes in the carbon nanotube peaks is increased and the field enhancement factor of the carbon nanotube peaks is increased as well. The field emission characteristics of the electron emitters 100 can be improved compared to the traditional carbon nanotube wire. The distance of the projecting carbon nanotubes of two adjacent carbon nanotube peaks 106 can be in a range from about 0.1 micrometers to about 2 micrometers. The ratio of the distance between the projecting carbon nanotubes and the diameter of the carbon nanotubes can be in a range from about 20:1 to about 500:1. Because the distance between the projecting carbon nanotubes is much greater than the diameter of the carbon nanotubes, the screening effect between the projecting carbon nanotubes is reduced. Because the electron emitters 100 include number of carbon nanotube peak 106, the electron density of the electron emitters 100 will be increased and the number of the electron emitters 100 can be reduced.

The carbon nanotube pipe 101 can be formed by closely wrapping a carbon nanotube film around the axis 107. The carbon nanotube film or can be wrapped layer upon layer. The thickness of the wall of the carbon nanotube pipe 101 can be determined by the number of the layers. The inner diameter and outer diameter of the main body 109 of the carbon nanotube pipe 101 can be selected according to need. The inner diameter of the carbon nanotube pipe 101 can be in a range from about 10 micrometers to about 30 micrometers. The outer diameter of the carbon nanotube pipe 101 can be in a range from about 15 micrometers to about 60 micrometers. In one embodiment, the inner diameter of the main body 109 of the carbon nanotube pipe 101 is about 18 micrometers, and the outer diameter of the main body 109 of the carbon nanotube pipe 101 is about 50 micrometers.

The electron emitter 100 can be applied to a field emission device such as a field emission display, a SEM, or a TEM. The field emission display has at least one cathode and at least one anode. The first end 102 of the electron emitter 100 can be connected to the cathode. The second end 104 of the electron emitter 100 points to the anode. When a voltage is applied between the electron emitter 100 and the anode, the electron emitter 100 can emit electrons under the voltage.

A method for making the electron emitter 100 includes the following steps:

S10, providing a linear support and at lease one carbon nanotube film;

S20, wrapping the at lease one carbon nanotube film or wire around the linear support;

S30, removing the linear support to obtain a carbon nanotube hollow cylinder;

S40, fusing the carbon nanotube hollow cylinder.

In the step S10, the linear support is configured to support the at least one carbon nanotube film or wire. Thus the linear support should have a certain strength and toughness. The linear support can simultaneously move along and rotate about an axial direction of the linear support. In addition, the linear support should be easily removed by a chemical method or a physical method. The material of the linear support can be metal, alloy, or plastics. The metal can be gold, silver, copper, or aluminum. The alloy can be a copper-tin alloy. In one embodiment, the linear structure is a copper-tin alloy wire including about 97 wt. % copper and about 3 wt. % tin. In one embodiment, the linear support can be a gold thread. A diameter of the gold thread is according to need. In one embodiment, the diameter of the gold thread is 18 micrometers.

The at least one carbon nanotube film or wire can be a free-standing structure. The carbon nanotube film can be a drawn carbon nanotube film, or a pressed carbon nanotube film. In the pressed carbon nanotube film, the carbon nanotubes are aligned along a single direction. The carbon nanotube film includes a number of carbon nanotubes distributed uniformly and attracted by van der Waals attractive force therebetween. The carbon nanotubes in the carbon nanotube film can be orderly or disorderly aligned. The orderly aligned carbon nanotubes are arranged in a consistently systematic manner, e.g., most of the carbon nanotubes are arranged approximately along a same direction or have two or more sections within each of which the most of the carbon nanotubes are arranged approximately along a same direction (different sections can have different directions). The disorderly aligned carbon nanotubes are arranged along many different directions, such that the number of carbon nanotubes arranged along each different direction can be almost the same (e.g. uniformly disordered), and/or entangled with each other.

If the carbon nanotube film in the step S10 is a drawn carbon nanotube film or a carbon nanotubewire, the step S20 can further includes the following substeps:

S110, providing a carbon nanotube array that is able to have a carbon nanotube film therefrom; and S120, drawing a carbon nanotube film from the carbon nanotube array.

In the step S110, the carbon nanotube array can be located on a substrate. The carbon nanotube array includes a number of carbon nanotubes. The number of carbon nanotubes in the carbon nanotube array can be approximately perpendicular to the substrate. The carbon nanotubes in the carbon nanotube array can be single-walled carbon nanotubes, double-walled carbon nanotubes, or multi-walled carbon nanotubes. The carbon nanotube array can be a super-aligned carbon nanotube array. The carbon nanotube array can be prepared by a chemical vapor deposition method, an arc discharge method, or a laser ablation method.

In the S120, the carbon nanotube film can be formed by the substeps of:

S122, selecting one or more carbon nanotubes having a predetermined width from the super-aligned array of carbon nanotubes; and S124, pulling the carbon nanotubes to form carbon nanotube segments that are joined end to end at an uniform speed to achieve a uniform carbon nanotube film.

In step S122, the carbon nanotube segments having a predetermined width can be selected by using a tool such as an adhesive tape, tweezers, or a clamp to contact the super-aligned array.

In step S124, the pulling direction can be substantially perpendicular to the growing direction of the super-aligned array of carbon nanotubes. Each carbon nanotube segment includes a number of carbon nanotubes substantially parallel to each other.

More specifically, during the pulling process, as the initial carbon nanotube segments are drawn out, other carbon nanotube segments are also drawn out end to end due to van der Waals attractive force between ends of adjacent segments. This process of drawing ensures a substantially continuous and uniform carbon nanotube film having a predetermined width can be formed. The carbon nanotube film includes a number of carbon nanotubes joined end to end. The carbon nanotubes in the carbon nanotube film are all substantially parallel to the pulling/drawing direction of the carbon nanotube film, and the carbon nanotube film produced in such manner can be selectively formed to have a predetermined width.

In the S20, a method for wrapping the at least one carbon nanotube film or wire around the linear support includes the following substeps:

S210, fixing one end of the carbon nanotube film or wire to the linear support; and S220, making a relative rotation between the linear support and the carbon nanotube film or wire, and simultaneously moving the linear support along an axial direction of the linear support.

During the step S220, an angle $\beta$ between the extending direction of the carbon nanotubes in the film or wire and the axial direction of the linear support can be greater than 0 degrees and less than 90 degrees. The carbon nanotube film or wire wrapping around the linear support forms a carbon nanotube layer. When the thickness of the carbon nanotube film or wire is predetermined, the greater the angle $\beta$, and the thicker the carbon nanotube layer. The thickness of the carbon nanotube layer can be changed by adjusting the $\beta$. In one embodiment, the thickness of the carbon nanotube layer is 6 micrometers.

The step S30 can be performed by a chemical method or a physical method, such as a mechanical method. If the linear support is made of an active metal or an alloy composed of active metals, such as iron or aluminum or gold foil, the step S40 can include a step of reacting the linear support with an acid liquid. If the material of the linear support is an inactive metal or an alloy includes inactive metals, such as gold or silver, the step S40 can be performed by heating to evaporate the linear support. If the material of the linear support is a polymer material, the step S40 can include a step of pulling the linear support out from the carbon nanotube layer using a stretching device along the axial direction of the linear support. The carbon nanotube film has a weak viscosity so that the carbon nanotube film can adhered to the liner support to form the carbon nantoube film, so the linear support can be easily pulled out from the carbon nanotube layer. Therefore, the shape and effective diameter of the linear support can decide the shape and effective inner diameter of the carbon nanotube hollow cylinder. If the cross-section of the linear support is a circular shape or a polygon, the inner surface of the carbon nanotube hollow cylinder will be a circular shape or a polygon. The inner diameter of the carbon nanotube hollow cylinder is the same as the diameter of the linear support. In one embodiment, the linear support is a gold thread. A method for removing the gold thread can include connecting the two ends of the gold thread to two electrodes, applying a current to the gold thread by the two electrodes in a vacuum, and heating the gold thread until the gold thread is evaporated.

In one embodiment, after the step S30 and before the step S40, the carbon nanotube hollow cylinder can be treated by an organic solvent.

Figure 9:
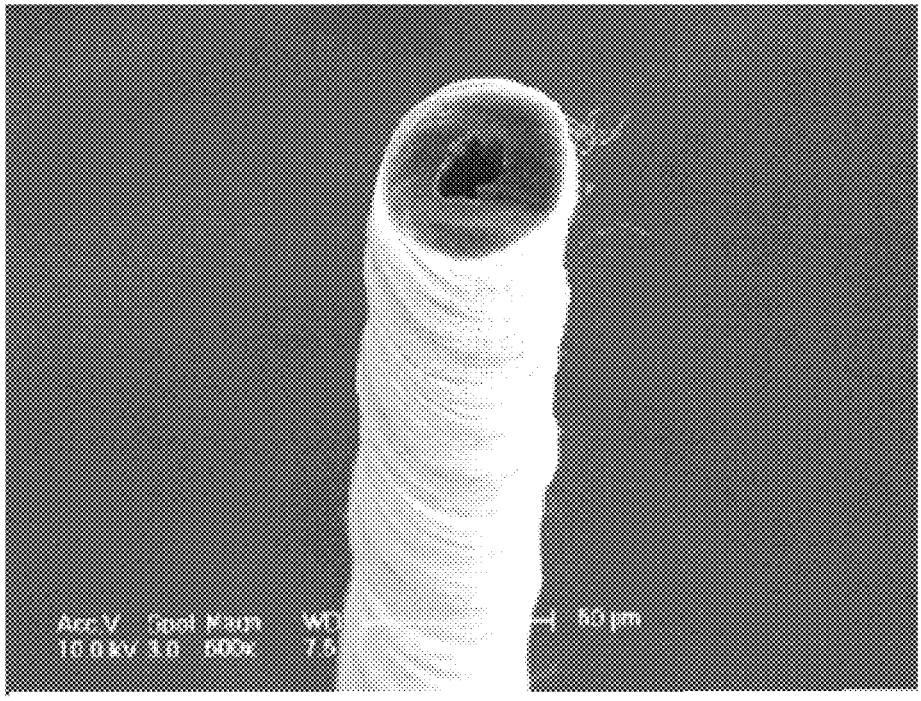
FIG. 9 is an SEM image of one embodiment of a carbon nanotube hollow cylinder.

Referring to FIG. 9, the carbon nanotube hollow cylinder includes a number of successive and oriented carbon nanotubes. Most of the carbon nanotubes are helically oriented around an axial direction of the carbon nanotube hollow cylinder. The helically oriented carbon nanotubes are joined end-to-end by van der Waals attractive force therebetween along a helically extending direction. The carbon nanotube hollow cylinder may have a few carbon nanotubes not helically oriented around the axial direction, but oriented disorderly and randomly. The angle between the helically extending direction and the centerline of the carbon nanotube hollow cylinder can be greater than 0 degrees and less than or equal to 90 degrees.

In the step S50, the carbon nanotube hollow cylinder can be fused by laser scanning, electron beam irradiation, ion beam irradiation, heating by supplying a current, and/or laser-assisted fusing after supplying current.

If the carbon nanotube hollow cylinder is fused by heating by supplying a current, the S50 can include the following substeps:

S512, placing the carbon nanotube hollow cylinder in a vacuum chamber or a chamber filled with inert gas; and S514, applying a voltage between two opposite ends of the carbon nanotube hollow cylinder, until the carbon nanotube hollow cylinder snaps at a certain point.

In the step S512, the vacuum chamber includes an anode and a cathode, which lead (i.e., run) from inside to outside of the vacuum chamber. Two opposite ends of the carbon nanotube hollow cylinder are attached to and electrically connected to the anode and the cathode, respectively. The pressure of the vacuum chamber is less than $2\times10^{-5}$ Pascal (Pa). In one embodiment, the pressure of the vacuum chamber is about $2\times10^{-5}$ Pa.

The structure of the chamber filled with inert gas is the same as the vacuum chamber. The inert gas can be helium or argon.

In the step S514, the voltage depends on the inner diameter, outer diameter, and the length of the carbon nanotube hollow cylinder. In one embodiment, the carbon nanotube hollow cylinder is about 2 centimeters in length, about 25 micrometers in the inner diameter, and about 40 micrometers in the outer diameter, and a 40 V direct current (DC) voltage applied. Consequently, the carbon nanotube hollow cylinder is heated by Joule-heating, and a temperature of the carbon nanotube hollow cylinder can reach an approximate range from 2000 Kelvin (K) to 2400 K. The resistance along the longitudinal axial of the carbon nanotube hollow cylinder is different, and thus the temperature distribution along the longitudinal axial of the carbon nanotube hollow cylinder is different. The greater the resistance and higher the temperature, the more easily it snaps. In one embodiment, after less than 1 hour (h), the carbon nanotube hollow cylinder snaps at a certain point to form two carbon nanotube pipes.

During snapping, some carbon atoms vaporize from the snapping portion of the carbon nanotube hollow cylinder. Each snapped carbon nanotube hollow cylinder has a break-end portion. The closer to the snapping position, the more carbon atoms are evaporated. Therefore, the neck portion is formed on the break-end portion of the snapped carbon nanotube hollow cylinder. After snapping, a micro-fissure is formed between the two break-ends, arc discharge may occur between the micro-fissure, and the carbon atoms are transformed into carbon ions due to ionization. These carbon ions bombard or etch the break-end portion to form a number of carbon nanotube peaks 106. A wall by wall breakdown of carbon nanotubes is caused by the Joule-heating at a temperature higher than 2000K. The carbon nanotubes at the broken ends have smaller diameters and a fewer number of graphite layers.

If the carbon nanotube hollow cylinder is broken by the electron emitter bombarding method, the S50 can include the following substeps:

S522, putting the carbon nanotube hollow cylinder in a vacuum chamber;

S524, applying a voltage between two opposite ends of the carbon nanotube hollow cylinder and heating the carbon nanotube hollow cylinder to a temperature of about 1800K to about 2500K; and S526, bombarding a predetermined point of the carbon nanotube hollow cylinder by an electron beam, until the carbon nanotube hollow cylinder snaps.

In the step S522, the pressure of the vacuum chamber is less than or equal to $1\times10^{-4}$ Pascal (Pa). In one embodiment, the pressure of the vacuum chamber is about $1\times10^{-5}$ Pa.

In the step S526, the electron beam can be emitted by an electron source, such as a carbon nanotube wire, a hot cathode, or any other field emission electron sources. A number of electron sources can be used together to obtain a larger electron current. The electron source is used to bombard a predetermined point of the carbon nanotube hollow cylinder. The predetermined point is located along the longitudinal axis of the carbon nanotube hollow cylinder. The electron source is arranged in the vacuum chamber. A distance between the electron source and the carbon nanotube hollow cylinder is in an approximate range from 50 micrometers to 2 millimeters (mm), typically, about 50 micrometers. The electron source can be in any direction, only if the electron source can bombard the predetermined point. With the electron bombarding, a temperature of the predetermined point is enhanced, and thus the temperature thereof is higher than the other points along the longitudinal axis of the carbon nanotube hollow cylinder. Consequently, the carbon nanotube hollow cylinder previously snaps at the predetermined point, and then two electron emitters 100 are formed.

If the carbon nanotube hollow cylinder is fused by the laser beam, the S50 can include the following substeps:

S532, irradiating a predetermined point of the carbon nanotube hollow cylinder with a laser beam; and S534, applying a voltage between two opposite ends of the carbon nanotube hollow cylinder, until the carbon nanotube hollow cylinder snaps.

In the step S532, the carbon nanotube hollow cylinder can be located in a controlled atmosphere. The atmosphere can be air or oxidizing gas.

The laser beam can be a carbon dioxide laser, semiconductor laser, UV laser, or any other laser. A power of the laser beam can be in a range from about 1 watt to about 12 watts, and a scanning velocity thereof can be in a range from about 100 mm/s to about 2000 mm/s. In one embodiment, the power of the laser beam is about 12 watts, and the scanning velocity thereof is about 1000 mm/S. The greater the power of the laser beam, the shorter the time that the laser beam irradiates the carbon nanotube hollow cylinder.

In the step S534, the carbon nanotube hollow cylinder can be placed in a vacuum chamber or a chamber filled with inert gas. Due to the heat of the laser beam, the carbon nanotube hollow cylinder is oxidized at the predetermined point, with some defects formed thereat, and thus the resistance at the predetermined point increases. The greater the resistance and higher the temperature, the more easily it snaps. The carbon nanotube hollow cylinder will be snapped at the predetermined point.

The steps S532 and S534 can be implemented simultaneously when the carbon nanotube hollow cylinder is placed in a vacuum chamber or a chamber filled with inert gas.

The above-described methods for making the electron emitter 100 are simple and increase the efficiency of making the electron emitter 100. By providing carbon nanotube peaks formed on the break-end of the carbon nanotube pipe, the field emission characteristic of the carbon nanotube pipe is improved.

Figure 10:
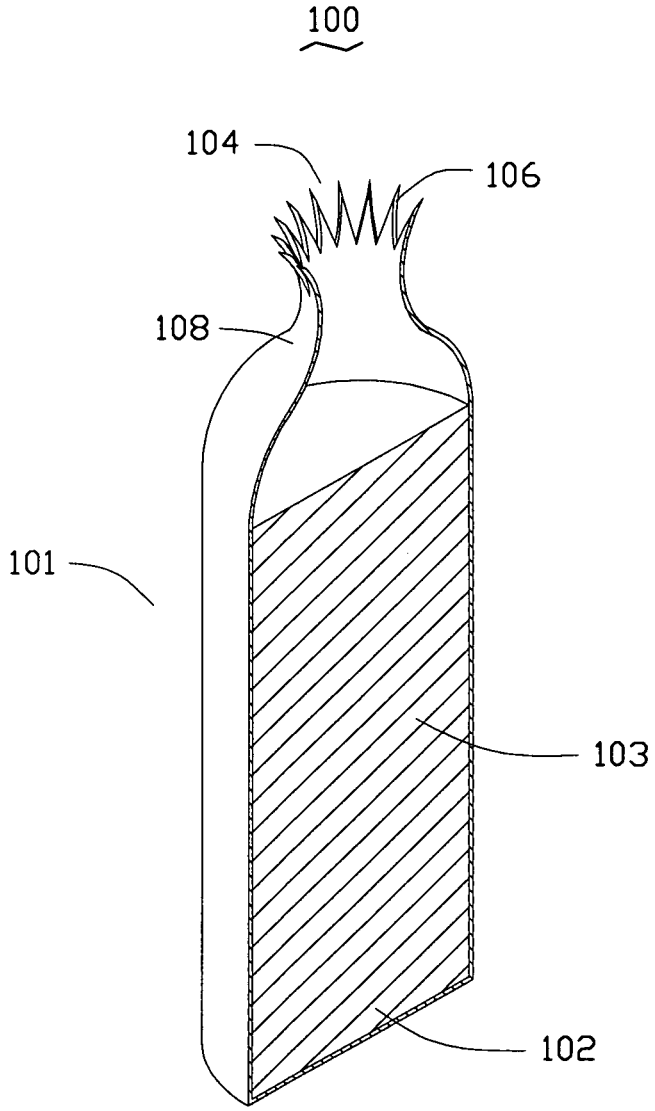
FIG. 10 is a schematic, cross-sectional view, along an axial direction of one embodiment of an electron emitter.

Referring to FIG. 10, the electron emitter 100 of one embodiment can be a carbon nanotube linear compound. The carbon nanotube linear compound includes a conductive linear support 103 and a carbon nanotube pipe. The carbon nanotube pipe includes a first end 104 and a second end 102. The first end 104 of the carbon nanotube pipe includes a hollow neck portion 108 and a number of carbon nanotube peaks 106 extending from a top of the hollow neck portion 108. The conductive linear support 103 is located in the carbon nanotube pipe and encased by the carbon nanotube pipe. The length of the conductive linear support 103 can be shorter than that of the carbon nanotube pipe. The conductive linear support 103 can also extend out of the carbon nanotube pipe from the second end 102 in one embodiment.

The conductive linear support 103 is configured to support the carbon nanotube pipe and improve the electric conductivity of the electron emitter 100. In one embodiment, the electric conductivity of the conductive linear support 103 is greater than the carbon nanotube pipe, and the field emission characteristic of the electron emitter 100 can be improved. The conductive linear support 103 can be made of conductive material. The conductive linear support 103 can be made of metal, alloy, or a linear structure coating a layer of conductive material. The metal can be gold, silver, copper, or aluminum. In one embodiment, the linear support is a gold thread. The diameter of the conductive linear support 103 can be in a range from about 10 micrometers to about 30 micrometers. In one embodiment, the conductive linear support 103 is a metal wire and the diameter of the metal wire is about 18 micrometers.

When the electron emitter 100 is a support carbon nanotube pipe, a method for making the electron emitter 100 includes the following steps:

S100, providing a conductive linear support and at lease one carbon nanotube film or wire;

S200, wrapping the at lease one carbon nanotube film or wire around the conductive linear support to form a support carbon nanotube pipe; and S300, breaking the support carbon nanotube pipe.

The method for making the electron emitter 100 in the FIG. 10 is similar to the method for making the electron emitter 100. The method for wrapping the at lease one carbon nanotube film or wire and the broken method can be identical to the two methods for making the electron emitters 100 described previously. The difference is that the linear support for making the electron emitter 100 in the FIG. 3 can be made of insulated material but the conductive linear support is used to make the electron emitter 100 in the FIG. 10. Furthermore, the conductive linear support cannot be removed before the fusing step in the method for making the electron emitter 100.

The melting point of the carbon nanotube pipe and the conductive linear support may be different. During the fusing process, the carbon nanotube pipe and the conductive linear support are heated to a very high temperature. If the melting point of the carbon nanotube pipe is lower than that of the conductive linear support, the carbon nanotube pipe will be first snapped at a predetermined point under the current, the laser, or electron beams. After the carbon nanotube pipe is snapped, the resistance of the conductive linear support corresponding to the snapped point of the carbon nanotube pipe will be raised. The greater the resistance; the higher the temperature. Therefore, the carbon nanotube pipe and the conductive linear support will be snapped at the same point. It is can be understood that if the melting point of the conductive linear support is lower than that of the carbon nanotube pipe, the conductive linear support and the carbon nanotube pipe can also be snapped at the same point.

The method for making the electron emitter 100 has the following benefits. First, the method for making electron emitter 100 is simple and the efficiency of making the electron emitter 100 can be improved. Second, the carbon nanotube peaks are formed on one end of the carbon nanotube pipe, therefore the field emission characteristic of the electron emitter 100 is improved. A conductive linear structure is located in the interior of the carbon nanotube pipe to help support the carbon nanotube pipe. The conductivity of the electron emitter 100 in the FIG. 10 is improved by the conductive linear structure if the electric conductivity of the conductive linear support 103 is greater than the carbon nanotube pipe.

One end of the electron emitters 100 are electrically connected to the row electrodes 120 by conductive adhesive, intermolecular forces or other suitable processes, for example flocking process, sticking one-by-one.

In operation, different voltages are applied to the row electrodes 120, the line electrodes 140 and the anode electrode 180. Generally, the voltage of the row electrodes 120 is zero or the row electrodes 120 are connected to ground. The voltage of the line electrodes 140 is ten to several hundred volts. The voltage of the anode electrode 180 is higher than the line electrodes 140. The electrons emitted by the electron emitters 100 of the cathode emitters 150 move towards the line electrodes 140 under the influence of the applied electric field induced by the line electrodes 140, and are then expelled through the holes 1302 and holes 1402. Finally the electrons reach the anode electrode 180 under the electric field induced by the anode electrode 180 and collide with the fluorescent layers 190 located on the anode electrode 180. The fluorescent layers 190 then emit visible light to accomplish display function of the field emission device 10. The row electrodes 120 are insulated from each other, as are the line electrodes 140. Thus, field emission currents at different cathode emitters 150 can be easily modulated by selectively changing the voltages of the row electrodes 120 and the line electrodes 140.

Figure 11:
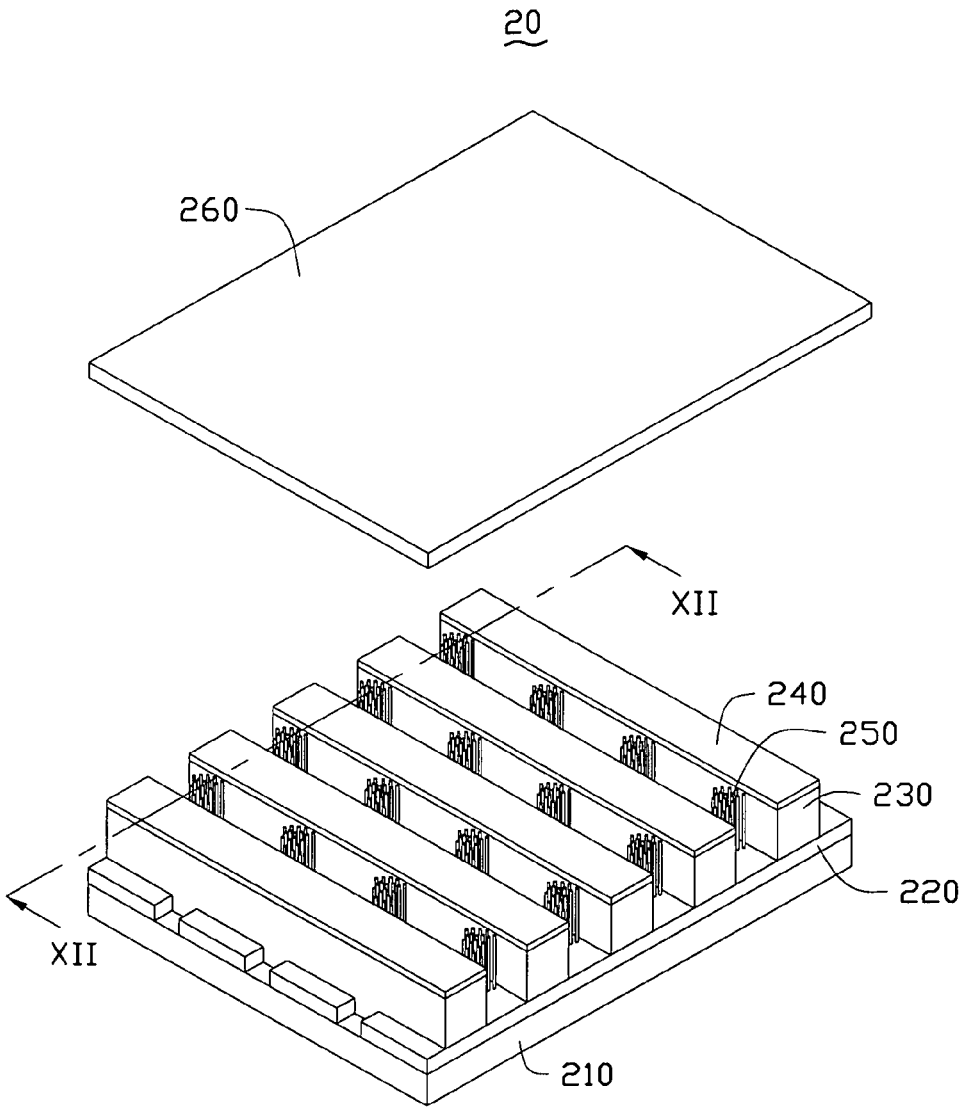
FIG. 11 is a schematic view of one embodiment of a field emission electronic device.
Figure 12:
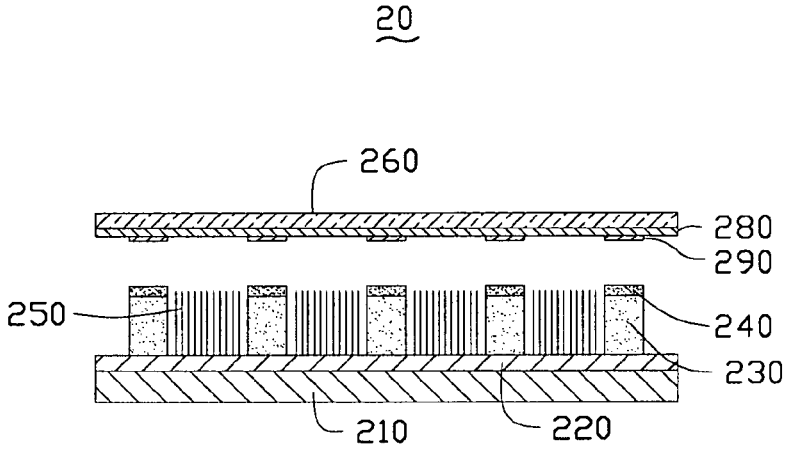
FIG. 12 is a schematic, cross-sectional view, along a line XII-XII of the field emission electronic device of FIG. 11.

Referring to FIG. 11 and FIG. 12, a field emission device 20 of one embodiment is provided. The field emission device 20 includes an insulating substrate 210, a number of row electrodes 220, a number of insulators 230, a number of line electrodes 240, a number of cathode emitters 250, an anode substrate 260, an anode electrode 280 and a number of fluorescent layers 290. The row electrodes 220 are located on a surface of the insulating substrate 210. The structure, material and method of making the insulating substrate 210, the row electrodes 220, the insulators 230, the line electrodes 240. The cathode emitters 250, the anode substrate 260, the anode electrode 280 and the fluorescent layers 290 are the same as the structure, material and method of making the insulating substrate 110, the row electrodes 120, the insulating layer 130, the line electrodes 140, the cathode emitters 150, the anode substrate 160, the anode electrode 180 and the fluorescent layers 190.

The difference between the field emission device 10 and the field emission device 20 is that the cathode emitters 250 are located on the two flanks of the line electrodes 240 along the extending direction of the row electrodes 220 and the fluorescent layers 290 correspond to the intersections of the row electrodes 220 and the line electrodes 240. The row electrodes 220 and the line electrodes 240 do not define holes. The cathode emitters 250 are not located on the intersection of the row electrodes 220 and the line electrodes 240.

In operation, different voltages are applied to the row electrodes 220, the line electrodes 240 and anode electrode 280. In one embodiment, the voltage of the row electrodes 220 is zero or the row electrodes 220 are connected to ground. The voltage of the line electrodes 240 is ten to several hundred volts. The voltage of the anode electrode 280 is higher than the voltage of the line electrodes 240. The electrons emitted by the cathode emitters 250 moves toward the line electrodes 240 under the influence of the applied electric field induced by the line electrodes 240. Finally the electrons reach the anode electrode 280 under the electric field induced by the anode electrode 280 and collide with the fluorescent layers 290 located on the anode electrode 280. The fluorescent layers 290 then emit visible light to accomplish display function of the field emission device 20. The row electrodes 220 are insulated from each other, as the line electrodes 240. Thus, field emission currents at different cathode emitters 250 can be easily modulated by selectively changing the voltages of the row electrodes 220 and the line electrodes 240.

Figure 13:
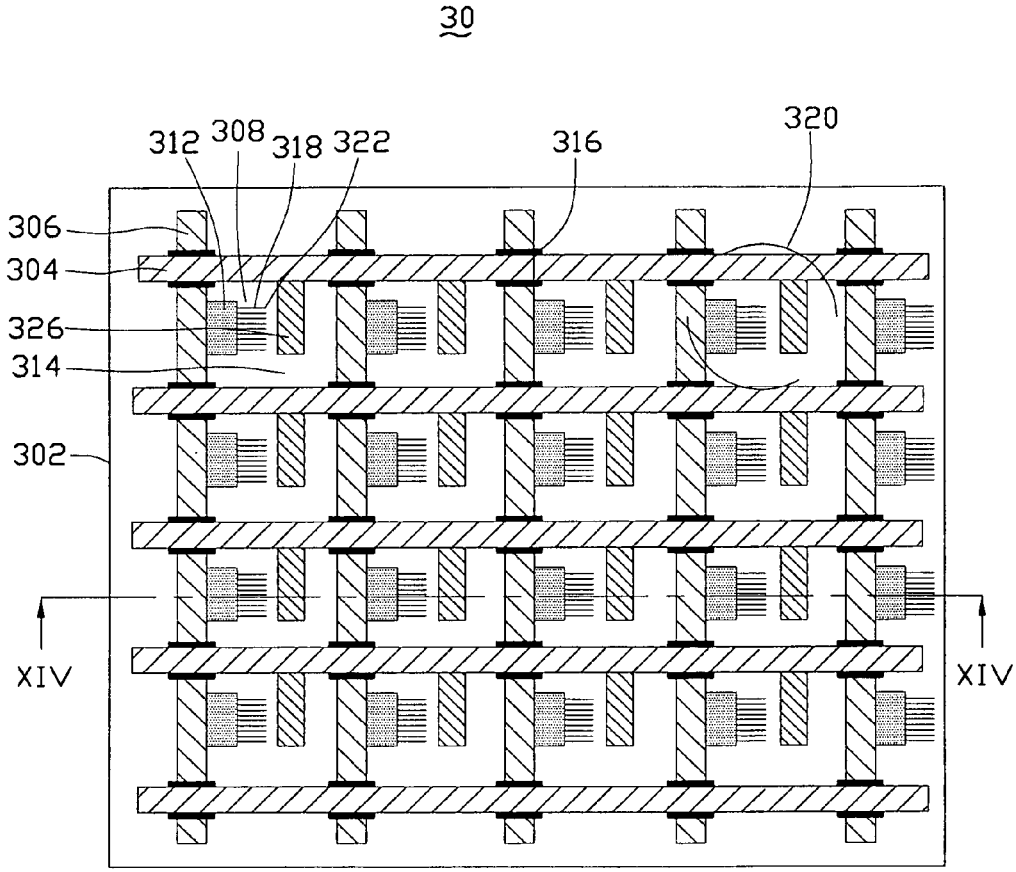
FIG. 13 is a top view of one embodiment of a field emission electronic device.
Figure 14:
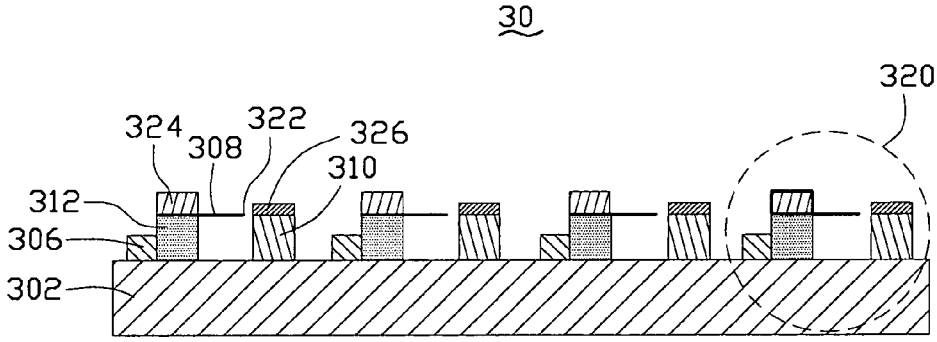
FIG. 14 is a schematic, cross-sectional view along line XIV-XIV of the field emission electronic device of FIG. 13.

Referring to FIG. 13 and FIG. 14, a field emission device 30 of one embodiment is provided. The field emission device 30 includes an insulating substrate 302, a number of electron emitting units 320, a number of row electrodes 304, a number of line electrodes 306 and a number of insulators 316. The row electrodes 304 are located on the insulating substrate 302. The row electrodes 304 are spaced apart from and parallel to each other. The line electrodes 306 are located on the insulating substrate 302. The line electrodes 306 are spaced apart from and parallel to each other. The row electrodes 304 are perpendicular to and cross the line electrodes 306. The insulators 316 are located on the intersections of the row electrode 304 and the line electrode 306 for providing electrical insulation between the row electrodes 304 and the line electrodes 306. Each two adjacent row electrodes 304 and line electrodes 306 form a lattice 314. One electron emitting unit 320 is located in each lattice 314.

Each of the electron emitting units 320 includes an anode electrode 310, a cathode electrode 312, a cathode emitter 308 and a fluorescent powder layer 326. The anode electrode 310 is opposite to and spaced apart from the cathode electrode 312. The anode electrode 310 is connected to the row electrodes 304. The cathode electrode 312 is connected to the line electrodes 306. The fluorescent powder layer 326 is located on surface of the anode electrode 310. The cathode emitters 308 are located between the cathode electrodes 312 and the anode electrode 310. One end of the cathode emitters 308 is connected to the cathode electrodes 312. An opposite end of each cathode emitter 308 points to the anode electrodes 310. The cathode emitters 308 are located on the surface of the insulating substrate 302. Moreover, the cathode emitters 308 are located over the insulating substrate 302 in one embodiment. That is, there is a space between the cathode emitters 308 and the insulating substrate 302. The space is provided to enhance the field emission abilities of the cathode emitters 308.

The difference between the field emission device 30 and the field emission device 20 is that the cathode emitters 308 are parallel to the insulating substrate 302 in the field emission device 30, but the cathode emitters 150, 250 are perpendicular to the insulating substrate 110, 210 in the field emission device 10, 20.

The insulating substrate 302 is an insulating board. Material of the insulating substrate 302 can be, for example, ceramics, glass, resins or quartz. In addition, a size and a thickness of the insulating substrate 302 can be chosen according to need. In one embodiment, the insulating substrate 302 is a glass substrate with a thickness of more than 1 mm (millimeter) and an edge length of more than 1 cm (centimeter).

In one embodiment, the row electrodes 304 and the line electrodes 306 are made of conductive material, for example, metal. In practice, the row electrodes 304 and the line electrodes 306 are formed by applying conductive slurry on the insulating substrate 302 using printing process, e.g. silk screen printing process. The conductive slurry composed of metal powder, glass powder, and binder. For example, the metal powder can be silver powder and the binder can be terpineol or ethyl cellulose (EC). Particularly, the conductive slurry includes 50% to 90% (by weight) of the metal powder, 2% to 10% (by weight) of the low-melting glass powder, and 8% to 40% (by weight) of the binder. In one embodiment, each of the row electrodes 304 and the line electrodes 306 is formed with a length ranging from about 20 micrometers to about 1.5 centimeters, a width ranging from about 30 micrometers to about 100 micrometers and with a thickness ranging from about 10 micrometers to about 500 micrometers. However, it is noted that dimensions of each of the row electrodes 304 and the line electrodes 306 can vary corresponding to dimension of each lattice 314. In one embodiment, each of the row electrodes 304 and the line electrodes 306 is formed with a length ranging from about 100 micrometers to about 700 micrometers, a width ranging from about 50 micrometers to about 500 micrometers and with a thickness ranging from about 20 micrometers to about 100 micrometers.

The cathode emitters 308 include at least one electron emitter 318. The electron emitters 318 are spaced apart from each other and parallel to each other. The electron emitters 318 can be the electron emitters 100 of the FIG. 3 or FIG. 10. The electron emitters 318 include a carbon nanotube pipe, and the carbon nanotube pipe is parallel to the insulating substrate 302. The electron emitters 318 have an electron emission portion 322 pointing to the anode electrode 310.

During the preparation of the field emission device 30, the electron emitters 318 can be formed by the following steps: laying at least one carbon nanotube hollow cylinder or support carbon nanotube pipe on the surfaces of the cathode electrode 312 and the anode electrode 310; cutting the carbon nanotube hollow cylinder or support carbon nanotube pipe to obtain an electron emitter 318. The cutting method can be laser heating, electron beam heating or electric current heating.

Figure 15:
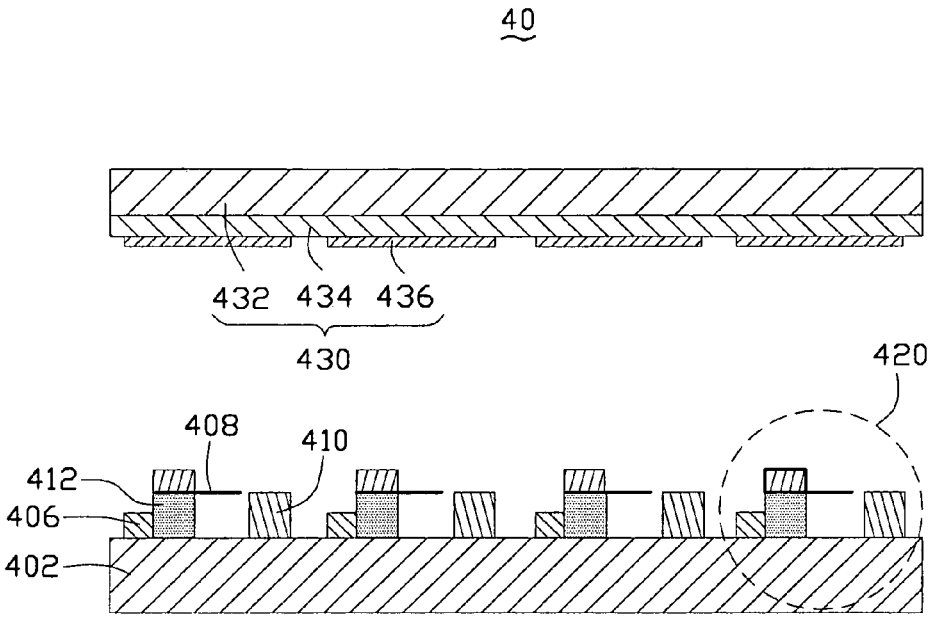
FIG. 15 is a schematic, cross-sectional view of one embodiment of a field emission electronic device.

Referring to FIG. 15, a field emission device 40 of one embodiment is provided. The difference between the field emission device 30 and the field emission device 40 is that the anode electrodes 310 of the field emission device 30 is substituted by grid electrodes 410 of the field emission device 40, the field emission device 40 further includes an anode device 430 compared to the field emission device 30.

The field emission device 40 includes a number of row electrodes 406, a number of electron emission units 420, and a number of line electrodes (not shown in FIG. 15. The row electrodes 406 and line electrodes form a number of grid. Each of the field emission units 420 includes a grid electrode 410, a cathode electrode 412 and a cathode emitter 408. The grid electrode 410 is connected to the row electrodes 406. The cathode electrode 412 is connected to the line electrodes. The grid electrode 410 and the cathode electrode 412 are spaced apart from each other. One end of the cathode emitter 408 is connected to the cathode electrode 412. An opposite end of the cathode emitter 408 points to the grid electrode 410.

In one embodiment, the anode device 430 includes a glass substrate 432, a transparent anode 434 and a number of fluorescent layers 436. The transparent anode 434 can be a tin indium oxide film. The electron emission units 420 are corresponding to the fluorescent layers 436. The cathode emitters 408 include at least one electron emitters. The electron emitters can be the electron emitters 100 of FIG. 3 or 10.

In operation, different voltages are applied to the row electrodes 406, the line electrodes and the anode electrode 434. The electrons emitted by the cathode emitters 408 moves toward the line electrodes under the influence of the applied electric field induced by the line electrodes. Finally the electrons reach the anode electrode 434 under the electric field induced by the anode electrode 434 and collide with the fluorescent layers 436 located on the anode electrode 434. The fluorescent layers 436 then emit visible light to accomplish display function of the field emission device 40. Field emission currents at different cathode emitters 408 can be easily modulated by selectively changing the voltages of the row electrodes 406 and the line electrodes.

It is to be understood that the above-described embodiments are intended to illustrate rather than limit the disclosure. Any elements described in accordance with any embodiments is understood that they can be used in addition or substituted in other embodiments. Embodiments can also be used together. Variations may be made to the embodiments without departing from the spirit of the disclosure. The above-described embodiments illustrate the scope of the disclosure but do not restrict the scope of the disclosure.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. A field emission electronic device comprising:

an insulating substrate having a surface;

a plurality of row electrodes located on the surface of the insulating substrate, spaced apart from and parallel to each other;

a plurality of cathode emitters located on the plurality of row electrodes and arranged in an array, each of the cathode emitters comprising at least one electron emitter, the at least one electron emitter comprising a carbon nanotube pipe, the carbon nanotube pipe having a first end, a second end and a main body connecting the first end and the second end; wherein the first end is electrically connected to one of the row electrodes, the second end comprises a plurality of carbon nanotube peaks;

an insulating layer located on the surface of the insulating substrate, wherein the insulating layer covers a portion of the plurality of row electrodes;

a plurality of line electrodes located on the insulating layer, spaced apart from and parallel to each other, wherein the plurality of line electrodes is perpendicular to and cross the plurality of row electrodes; and an anode device comprising an anode substrate, an anode electrode and a plurality of fluorescent layers, wherein the plurality of fluorescent layers corresponds to the intersections of the plurality of row electrodes and the plurality of line electrodes.

2. The field emission electronic device of claim 1, the carbon nanotube pipe further comprises a plurality of carbon nanotubes surrounding an axis of the carbon nanotube pipe.

3. The field emission electronic device of claim 1, wherein the second end defines an opening and comprises a hollow neck portion connected to the main body.

4. The field emission electronic device of claim 3, wherein the plurality of carbon nanotube peaks extends from a top of the hollow neck portion to surround the opening.

5. The field emission electronic device of claim 2, wherein the plurality of carbon nanotube peaks is located around the axis of the carbon nanotube pipe, spaced apart from each other to form a ring shape and points to the anode electrode.

6. The field emission electronic device of claim 2, wherein the plurality of carbon nanotube peaks extend substantially parallel with the axis.

7. The field emission electronic device of claim 2, wherein the plurality of carbon nanotube peaks extends along different directions across the axis to form a radial shape.

8. The field emission electronic device of claim 1, wherein each of the plurality of carbon nanotube peaks comprises a plurality of carbon nanotubes substantially parallel to each other and joined by van der Waals attractive force.

9. The field emission electronic device of claim 2, wherein each of the plurality of carbon nanotube peaks is a tapered carbon nanotube bundle, and a single projecting carbon nanotube projects over other carbon nanotubes in the same tapered carbon nanotube bundle.

10. The field emission electronic device of claim 9, wherein the single projecting carbon nanotube is located in a middle of the other carbon nanotubes.

11. The field emission electronic device of claim 9, wherein a distance of the projecting carbon nanotubes of two adjacent carbon nanotube peaks is in a range from about 0.1 micrometers to about 2 micrometers.

12. The field emission electronic device of claim 9, wherein the carbon nanotube pipe comprises a plurality of successive carbon nanotubes, helically oriented around the axis of the carbon nanotube pipe, that are joined end-to-end by van der Waals attractive force therebetween.

13. The field emission electronic device of claim 1, wherein both of the insulating layer and the plurality of line electrodes define a plurality of holes corresponding to the intersections of the plurality of row electrodes and the plurality of line electrodes, and the plurality of cathode emitters is located in the plurality of holes and electrically connected to the plurality of row electrodes.

14. The field emission electronic device of claim 1, wherein the insulating layer comprises a plurality of insulators spaced apart from each other, and the plurality of insulators is perpendicular to and cross the plurality of row electrodes.

15. The field emission electronic device of claim 1, wherein the plurality of cathode emitters is located on two flanks of the plurality of line electrodes along an extending direction of the row electrodes.

16. A field emission electronic device comprising:

an insulating substrate having a surface;

a plurality of row electrodes located on the surface of the insulating substrate, wherein the plurality of row electrodes is spaced apart from and parallel to each other;

a plurality of line electrodes located on the surface of the insulating substrate, wherein the plurality of line electrodes is spaced apart from and parallel to each other, the plurality of row electrodes cross the plurality of line electrodes to form a plurality of lattices;

a plurality of electron emitting units, wherein each of the plurality of electron emitting units is located in one respective lattice, each of the plurality of electron emitting units comprising:

a first electrode connected to one corresponding row electrode;

a second electrode connected to one corresponding line electrode and spaced from the first electrode;

a cathode emitter connected to the first electrode, the cathode emitter comprising at least one carbon nanotube pipe, each of the at least one carbon nanotube pipe comprising a first end, a second end and a main body connecting the first end and the second end;

wherein each of the first ends is electrically connected to the first electrode, and each of the second ends defines an opening and comprises a plurality of tapered carbon nanotube bundles located around the opening.

17. The field emission electronic device of claim 16, wherein each of the electron emitting units further comprises a fluorescent layer located on a surface of the second electrode.

18. The field emission electronic device of claim 16, further comprising a third electrode spaced apart from the insulating substrate, and a plurality of fluorescent layers located on the third electrode and oriented to the insulating substrate, each of the fluorescent layers corresponds to one electron emitting unit.

19. A field emission electronic device comprising:

an insulating substrate;

a first electrical conductor located on a surface of the insulating substrate;

a plurality of electron emitters connected to the first electrical conductor, wherein each of the plurality of electron emitters comprises a carbon nanotube pipe, the carbon nanotube pipe has one end comprising a plurality of tapered carbon nanotube bundles, the plurality of tapered carbon nanotube bundles is located around an axis of the carbon nanotube pipe and spaced apart from each other to form a ring shape; and a second electrical conductor spaced apart from and insulated from the first electrical conductor.

20. The field emission electronic device of claim 19, wherein the second electrical conductor is located on the surface of the insulating substrate.

* * * * *